United States Patent [19]

Mueller

[11] 3,944,205

[45] Mar. 16, 1976

[54] ADJUSTING MECHANISM FOR STIRRUP EXTENSION BAR FOR MEDICAL EXAMINATION TABLE

[75] Inventor: Floyd F. Mueller, Two Rivers, Wis.

[73] Assignee: American Hospital Supply Corporation, Evanston, Ill.

[22] Filed: May 20, 1974

[21] Appl. No.: 471,474

Related U.S. Application Data

[63] Continuation-in-part of Ser. No. 329,380, Feb. 5, 1973, abandoned.

[52] U.S. Cl. ..... 269/328

[51] Int. Cl.[2] ..... B25B 1/14

[58] Field of Search ..... 269/166–171, 269/203–206, 322–328; 248/124, 188.5, 298; 211/123, 124, 105.3, 96, 7; 403/104; 188/40, 67; 308/3 R

[56] References Cited

UNITED STATES PATENTS

| | | | |
|---|---|---|---|
| 562,428 | 6/1896 | Sell | 269/324 |
| 2,804,362 | 8/1957 | Spielberg | 269/328 |
| 3,719,403 | 3/1973 | Sung | 308/3 R |

FOREIGN PATENTS OR APPLICATIONS

| | | | |
|---|---|---|---|
| 357,845 | 12/1961 | Switzerland | 248/298 |
| 130,818 | 1/1949 | Australia | 269/166 |

*Primary Examiner*—Harold D. Whitehead
*Attorney, Agent, or Firm*—Dawson, Tilton, Fallon & Lungmus

[57] ABSTRACT

A stirrup extension bar is slidably received in an elongated tubular channel equipped at its mouth with a brake pad, and the innermost end of the extension bar is equipped with a brake pad. If the coefficient of friction between the pads and interior channel walls is greater than about 0.9, the horizontal frictional forces tending to hold the bar in place are sufficiently greater than the force tending to unseat the bar, so that the bar remains locked in place. When the stirrup assembly held by the outer end of the extension bar is raised, the brake pads release and the extension bar may be adjusted horizontally. Normal use forces apply the locking force after adjustment.

4 Claims, 4 Drawing Figures

ADJUSTING MECHANISM FOR STIRRUP EXTENSION BAR FOR MEDICAL EXAMINATION TABLE

RELATED APPLICATION

This is a continuation-in-part of my copending, coowned application for "Adjusting Mechanism for Stirrup Extension Bar for Medical Examination Table", Ser. No. 329,380, filed Feb. 5, 1973, now abandoned.

BACKGROUND AND SUMMARY

The present invention relates to medical examination tables; and more particularly, it relates to a mechanism for horizontally adjusting and locking in place left and right stirrup assemblies extending from the foot of the table.

Heretofore, the horizontally extensible rods which support the stirrup assemblies for a medical examination table have been locked in their horizontal adjustment by means of a hand wheel with a threaded stud that is received in the side of the table and adapted to engage and secure the rod after it has been adjusted to the proper distance from the table. This has normally required the use of both hands, one for unloosening the turn wheel and the other for adjusting the extension of the rod. A further disadvantage in the use of prior adjustment assemblies for stirrup extension rods is that during use, the normal up and down forces applied to the stirrup assembly tend to wiggle the rod and to loosen the tightening screw on the hand wheel.

In the present invention, a rectangular channel with a flat top wall is provided in the examination table for receiving a corresponding rectangular extension bar provided at its distan end with a stirrup assembly. A separate mechanism is included for permitting vertical and angular adjustment of the stirrup assembly, but it forms no part of the present invention.

A first brake pad is affixed to the upper inner surface of the extension bar so that it is carried along with it during adjustment. A second brake pad is secured to the lower surface of the channel adjacent its mouth. There is a slight vertical clearance provided in the channel so that the rod may be moved back and forth in the unlocked position which is achieved by lifting the stirrup assembly upwardly. When the stirrup assembly is placed in its proper horizontal adjustment and released, the normal gravity force on the stirrup assembly pivots the innermost end of the rod about the second brake pad adjacent the mouth of the channel until the first brake pad on the top of the rod engages the top of the channel, thereby applying braking action at two positions to lock the rod in place and prevent against further horizontal adjustment.

The channel walls are enameled still and the pads may be rubber or neoprene. In either case there is a coefficient friction of about 0.9 between the pads and walls which, as will be discussed further within, results in combined frictional holding forces at least twice as great as the maximum encountered force on the stirrup tending to further extend it. Hence, the bar is locked in place.

During normal use, the additional downward force exerted by the leg being supported or by any downward pressure applied by the person being treated or examined, (which is the normal occurrence) will cause a further pressure on the brake pads, thereby resulting in an even greater frictional engagement between the extension bar and the channel to prevent horizontal movement of the bar from the adjusted position.

Thus, the present invention provides an adjusting and locking mechanism in which the horizontal extension bar is released from its locked position simply by raising the stirrup assembly, and adjustment is achieved by sliding the bar to its desired length. In addition, the normal forces encountered during use tend to achieve an even greater locking force on the adjustment assembly.

Other features and advantages of the present invention will be apparent to persons skilled in the art from the following detailed description of a preferred embodiment accompanied by the attached drawing wherein identical reference numerals will refer to like parts in their various views.

THE DRAWING

DETAILED DESCRIPTION

Figures 1, 2, 3, 4:
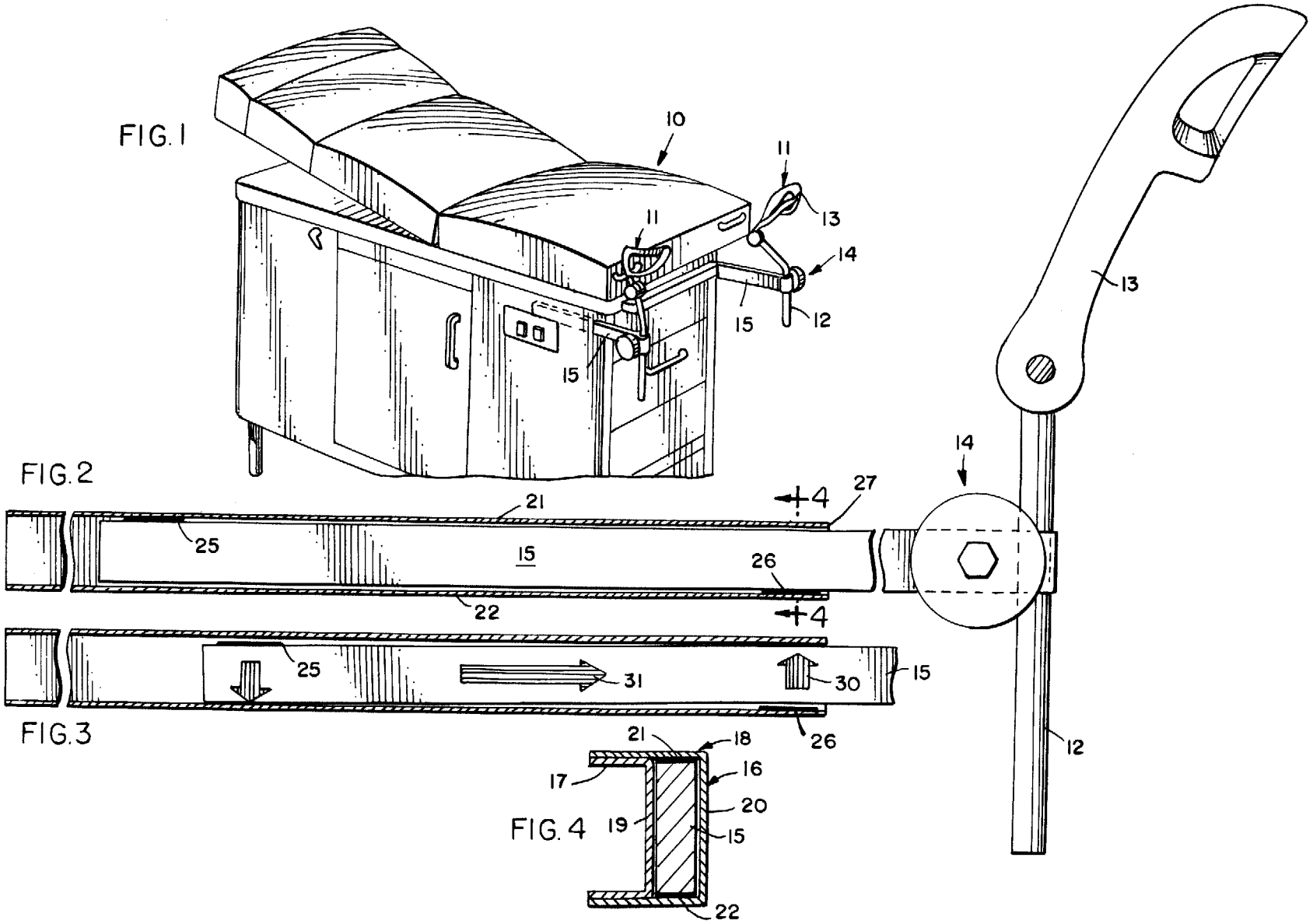
FIG. 1 is a fragmentary perspective view taken from the foot end of a medical examination table incorporating the present invention.
FIG. 2 is a vertical cross sectional view of the adjusting and locking mechanism of the present invention with portions of the channel and bar cut away.
FIG. 3 is a view similar to FIG. 2 absent the stirrup assembly and with the mechanism in the release position.
FIG. 4 is a transverse cross sectional view of the adjusting and locking mechanism taken through the sight line 4—4 of FIG. 2.

Turning then to the drawing, reference numeral 10 generally designates a medical examination table having first and second stirrup assemblies 11 located at the left and right sides of the foot end. Each of the stirrup assemblies 11 includes a support rod 12 holding a stirrup 13. The stirrup assemblies 11 are adjustable vertically and angularly by means of a vertical adjustment mechanism generally designated 14 which, as mentioned, forms no part of the present invention. More details regarding the vertical adjustment mechanism 14 may be obtained from the co-owned, copending application of Floyd F. Mueller, et al., for "Clamping Mechanism for Adjusting Stirrup on a Medical Examination Table", Ser. No. 329,452.

Each of the stirrup assemblies 11 is mounted to the distal end of a horizontal extension bar 15, the height of the center of the stirrup assembly 11 relative to the bar 15 has a bearing on the frictional locking force, as will be made clear. It is preferred that this height be at least about seven inches. The bar is slidably received in a channel generally designated 16 in FIG. 4 within the cabinet beneath the patient support portion of the examination table 10. As seen in FIG. 4, the bar 15 has a rectangular shape with a greater depth than width.

The channel 16 is formed by fitting a first U-shaped channel member 17 within a second U-shaped channel member 18. Both members are preferably enameled steel. The web portions 19 and 20 respectively of the U channel members 17 and 18 are spaced laterally apart by a distance slightly greater than the width of the extension bar 15 to allow clearance, and the height of the resulting channel ly is slightly greater than the height of the extension bar 15, as will be described presently. Thus, in addition to the two side web portions 19, 20, the channel 16 is defined by a top wall portion 21 and a bottom wall portion 22, thus forming a closed tubular channel for telescopically receiving the extension bar 15.

On the upper surface of the extension bar 15 adjacent the inboard end thereof is a thin brake pad 25 which is preferably made of neoprene, rubber, or equivalent material which has the property of high frictional engagement when it contacts the under surface of the upper wall 21. For example, if the channel is made of enameled steel and the pad is neoprene or rubber, the coefficient of friction between the two is 0.9, and it is preferred that the resulting coefficient of friction be at least about 0.9 to achieve reliable locking action on the extension bar against further horizontal movement.

The brake pad 25 may be secured to the rod 15 with any suitable bonding agent, such as contact adhesive. Similarly, a braking pad 26 is secured to the upper surface of the bottom wall 22 of the channel 16 adjacent its mouth, designated 27. Typical dimensions for the brake pads 25, 26 are 1/16 in. thick, 5/16 in. wide, and 1 in. long.

In operation, when it is desired to adjust the extension of the bar 15, the stirrup assembly 11 or the bar itself may be grasped in one hand and urged in the direction of the arrow 30, (that is, upwardly). This releases the frictional engagement between the contact pads 25, 26 and their associated engaged areas on the undersurface of the upper wall 21 and the under surface of the bar 15 respectively. Next, the entire assembly may be pulled outwardly in the direction of the arrow 31 if it is desired to increase the distance of the stirrup assembly from the foot of the table 10, or it may be pushed inwardly, if desired. When the stirrup assembly is released it will fall under gravity with the lower brake pad 26 acting as a fulcrum for a clockwise rotation of the extension bar 15 until the upper brake pad 25 engages the top wall 21 of the channel 16, locking the bar 15 in its predetermined horizontal extension.

Considering now the forces involved in locking the extension bar in place, in relation to those tending to unseat it, the following nomenclature will be used:

Force A is the vertical force exerted by the pad 25 on the upper channel wall 21.

Force B is the vertical support force exerted by the extension bar 15 on the fixed friction pad 26 adjacent the mouth of the channel.

$F_A$ is the frictional force between the pad 25 and channel due to Force A.

$F_B$ is the frictional force between the bar 15 and the pad 26 due to Force B.

Coefficient of friction between steel and Neoprene rubber or rubber is approximately 0.9.

W is the force applied by a patient's leg.

The worst case, in the sense of applying a force tending to unseat the bar 15 in relation to the frictional forces holding it in place is encountered when the bar 15 is located in its innermost, not outermost position. In this position, the applied force, W, due to the patient's leg is applied at an angle of approximately 60° relative to the horizontal. The center of the application of the Force W to the stirrup occurs at 7 in. above the bar 15, and 2.75 in to the right of the stirrup rod; and this may be resolved into a vertical component, $W_V = 0.86\ W$, and a horizontal component, $^{W}H = 0.50\ W$. In this condition, for the illustrated design, the distance between the Force A and the application of Force W on the stirrup is 21.75 in. The horizontal distance between Force B and the stirrup rod is 2 in. (leaving the distance between Force A and Force B to be 17 in.).

Summing the moments produced by the above forces about the pad 25, $$0 = (17 \times B) - (0.86\ W \times 21.75) - (0.50\ W \times 7)$$

From the above, a simple calculation will show that Force $B$ is 1.3 $W$. The frictional force is 0.9 × Force $B$, and this results in: $F_B = 1.17\ W$.

Taking a similar approach of summing the moments about the pad 26, and applying the same coefficient of friction, the frictional force $F_A$ can be computed to be 0.40 W. Hence, the total frictional force tending to maintain the bar 15 in place is $1.17\ W + 0.40\ W = 1.57\ W$. The force tending to unseat the bar, from the above, $W_H = 0.5\ W$. Hence, the total frictional force between the channel and the bar is over three times the force tending to unseat the bar under what might be considered worse case conditions for normal use.

If the bar is extended such that the distance between the stirrup and the pad 26 is 17 in., and it is assumed that the applied weight W is applied at a 10° angle relative to the horizontal, using the same figures and approach, the same computation leads to the result that the total horizontal holding force on the bar 15 is greater than nine times the horizontal component of the applied weight which tends to unseat the bar. Thus, the further the bar 15 is extended, the greater is the locking force, and reliability is therefore greater.

It will be observed from the above that when the mechanism is adjusted, any increase in downward force on the stirrup assembly 11 will cause even further normal force on each of the brake pads 25, 26 to increase the frictional engagement during normal use conditions, thereby rendering the locking mechanism more reliable rather than less reliable during use.

Having thus described in detail a preferred embodiment of the present invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. In an examination table having first and second foot rest assemblies located respectively at the left and right sides of the foot end of the table, the improvement wherein each of said foot rest assemblies comprises: a horizontal support bar having inner and outer ends; a stirrup assembly carried by the outer end of said bar; a closed tubular channel in said table for telescopically receiving said bar and conforming to the shape of said bar with clearances on all sides; and first and second brake pads of resilient, compressible material located respectively on the upper surface of the inner end of said bar and the lower surface of said channel adjacent the mouth thereof, the material of said channel and said brake pads being such that the coefficient of friction therebetween is at least about 0.9, whereby a downward force on said stirrup assembly will cause said extension bar to frictionally engage said second brake pad and pivot thereabout while said first brake pad frictionally engages the under surface of the top of said channel to lock said bar against further horizontal movement, said frictional engagement between said bar and channel being the sole force locking said bar in place.

2. The structure of claim 1 wherein each of said brake pads is tubber or neoprene having a thickness of about one-sixteenth in.

3. The structure of claim 2 characterized in that each of said channel and said extension bar has a rectangular cross section with a greater height than width; and said channel is enameled steel.

4. The structure of claim 3 wherein said channel is formed from two generally U-shaped channel members turned on their sides, each having a web portion, said webs being spaced apart to define the width of said channel.

* * * * *